United States Patent [19]

Seragnoli

[11] Patent Number: 4,483,351

[45] Date of Patent: Nov. 20, 1984

[54] TURNAROUND DEVICE FOR ROD-LIKE ARTICLES, IN PARTICULAR CIGARETTES

[75] Inventor: Enzo Seragnoli, Bologna, Italy

[73] Assignee: G. D. Societa per Azioni, Bologna, Italy

[21] Appl. No.: 406,032

[22] Filed: Aug. 6, 1982

[30] Foreign Application Priority Data

Sep. 29, 1981 [IT] Italy ..... 49393 A/81

[51] Int. Cl.[3] ..... A24C 5/35

[52] U.S. Cl. ..... 131/282; 131/94; 198/374

[58] Field of Search ..... 131/282, 283, 94; 198/951, 377, 374, 438, 456

[56] References Cited

U.S. PATENT DOCUMENTS 4,090,602 5/1978 Schubert et al. ..... 198/951

*Primary Examiner*—V. Millin

*Attorney, Agent, or Firm*—Marshall, O'Toole, Gerstein, Murray & Bicknell

[57] ABSTRACT

A turnaround device for rod-like articles, in particular cigarettes, in which a conveyor device is operable to advance the articles in a direction transverse their axes and arranged in two rows; the articles of one row being supported by the conveyor device by means of associated fixed supports which are uniformly spaced, and the articles of the other row being carried by the conveyor device via respective movable supports each of which is given a reciprocating rotary movement around an arc of 180° about an axis disposed transversely both to the associated article and to the direction of advance, and a reciprocating translational movement parallel to the axis of rotation.

6 Claims, 2 Drawing Figures

TURNAROUND DEVICE FOR ROD-LIKE ARTICLES, IN PARTICULAR CIGARETTES

BACKGROUND OF THE INVENTION

The present invention relates to a turnaround device for rod-like articles, in particular cigarettes.

The turnaround device of the present invention is particularly adapted to be used for arranging filter cigarettes which are initially positioned adjacent one another in two rows and aligned together in pairs with their filters facing one another, into a single row with their filters all disposed at the same end. In the following description reference will only be made to the specific field of use described above without, however, any loss of generality since the present invention can advantageously be used, without substantial modifications, for turning around any rod-like object.

In the manufacture of filter cigarettes it is known to proceed by forming pairs of lengths of cigarette which are aligned with one another. The facing ends of the cigarette lengths of each pair are subsequently connected together by means of a double filter, that is to say a filter the length of which is twice that of the filter for a single cigarette. Each assembly thus formed is then separated by cutting the said double filter into equal parts in such a way as to obtain two cigarettes each with a complete filter.

Once the cutting of the double filter has been performed the cigarettes thus obtained are caused to advance transversely of their axes along two parallel rows by means of a conveyor device, and can be sent on from this latter to two separate packaging machines each fed from an associated said row of cigarettes.

Alternatively, both the said rows of cigarettes can be supplied to a single packaging machine after having turned the cigarettes of one of the said rows round by 180° onto the other row in such a way as to form a single row of cigarettes advancing transversely of their axes and all having their filters disposed on one and the same side. The best known turnaround devices normally include a conveyor device constituted by a cylindrical body which is rotatable about its axis and carries on its outside first and second rows of cigarette-carrier cradles.

Cradles of both the said rows are normally movable with respect to the conveyor device; in particular, the cradles of the first row are normally able to translate transversely of their axes in a radial direction with respect to the said cylindrical body, whilst the cradles of the second row are normally able to rotate, each about an associated axis at its end facing the corresponding cigarette of the first row and skew with respect both to the axis of rotation of the said cylindrical body and to the axis of the associated cradle. From the above it can be seen that known turnaround devices of the type described above, because of the necessity of displacing all the cradles, are extremely complicated from the structural point of view and, therefore, of high cost and low reliability, especially when driven at the extremely high velocities required by modern packaging machines.

SUMMARY OF THE INVENTION

The object of the present invention is that of providing a turnaround device the structural simplicity of which permits the above mentioned disadvantages of the above described known turnaround devices to be eliminated.

The said object is achieved by the present invention in that it relates to a turnaround device for rodlike articles, in particular cigarettes, comprising a conveyor device operable to advance the said articles in a direction transverse their axes, and a plurality of supports connected to the said conveyor device and aligned along first and second parallel rows, the said supports being distributed with a constant spacing or pitch which is equal for both the said rows, each said support being able to house a respective said article, characterised by the fact that each support of the said first row is fixed with respect to the said conveyor device, whilst each support of the said second row is connected to the said conveyor device by an associated turnaround unit, each turnaround unit including first actuator means operable to impart to the associated said support a reciprocating translational movement in a direction substantially transverse both a longitudinal axis of the support itself and of the said direction of advance, and second actuator means operable to impart to the associated said support a rotation through 180° starting from an initial position of juxtaposition with a corresponding support of the said first row and about an axis, substantially parallel to the said direction of translation, located at the end of the associated said article facing the supports of the said first row in the said initial position and offset with respect to the longitudinal axis of the associated said support by a distance equal one quarter of the said spacing or pitch.

BRIEF DESCRIPTION OF THE DRAWINGS

Further characteristics and advantages of the present invention will become apparent from the following description with reference to the attached drawings, which illustrate two different non limitative embodiments thereof, and in which.

DETAILED DESCRIPTION OF THE INVENTION

Figure 1:
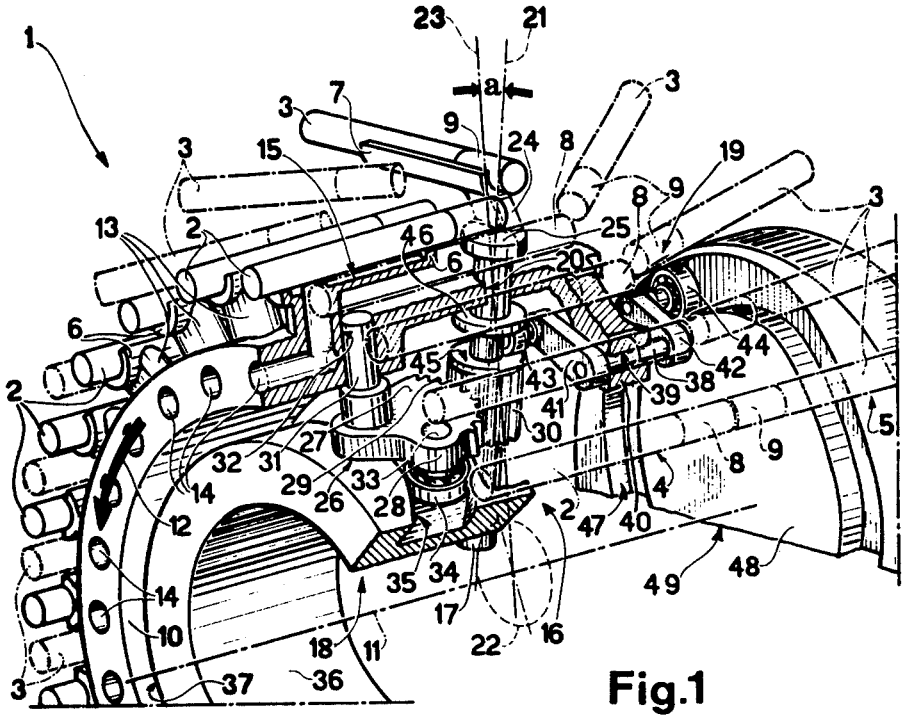
FIG. 1 is a schematic perspective view with parts in section and parts removed for clarity, of a portion of a turnaround device formed according to the principles of the present invention.

In FIG. 1 there is illustrated a turnaround device generally indicated with the reference numeral 1 and which can be used to arrange cigarettes 2 and 3 which are initially disposed in two parallel adjacent rows 4 and 5 above respective transport cradles 6 and 7 into a single row in adjacent positions. In particular, in the said initial position, each cigarette 2 is located above the associated cradle 6 in a position coaxial with respect to the corresponding cigarette 3 carried by the associated cradle 7 and with its filter 8 located adjacent and substantially in contact with the free end of a filter 9 of the corresponding cigarette 3.

The cradles 6 and 7 are spaced with a constant pitch P (FIG. 2) which is the same for both rows 4 and 5, along a conveyor deivce 10 which is operable to make the cradles 6 and 7 advance in a direction substantially transverse their longitudinal axes. The conveyor device 10 is constituted in the illustrated example by a torodial drum which is rotatable about a central axis 11 under the thrust of drive means not illustrated and in a direction indicated by an arrow 12.

Each cradle 6 is located outside the outer cylindrical surface of the drum 10 with its longitudinal axis in a position substantially parallel to the axis 11, and is rigidly connected to the drum 10 by means of an associated attachment bracket 13. This latter is traversed by a duct 14 a first end of which extends axially through the drum 10 and is adapted to communicate, at least along a part of the path followed by the associated cradle 6, with a suction device not illustrated, and a second end which communicates with a bottom groove 15 formed axially along the associated cradle 6.

Each cradle 7 also has a groove (not illustrated) in its bottom communicating with the said suction device (not illustrated) and is supported on the drum 10 by means of a respective turnaround unit generally indicated 16. The unit 16 includes a shaft 17 which cooperates with first and second actuator devices respectively indicated 18 and 19. Each shaft 17 extends rotatably and axially slidably through a respective hole 20 in the drum 10. Each hole 20 has an axis 21 which, in a variant not illustrated, is disposed radially with respect to the drum 10, whereas in the embodiment illustrated in FIG. 1 it is disposed tangentially to a circle 22 of given radius coaxial with the axis 11 in such a way as to form an angle a with a radius 23 of the drum 10 passing through the said hole 20.

The connection between each cradle 7 and the associated shaft 17 is formed by means of a bracket 24 connected to that end of the associated cradle 7 initially facing the corresponding cradle 6. In particular, each bracket 24 is rigidly connected to the outer periphery of a small plate 25 at the end of the shaft 17 in an offset position with respect to the axis 21 and at a distance d therefrom (see FIG. 2) of one quarter of the pitch P or spacing of the cradles 6 along the drum 10. In the embodiment illustrated in FIG. 1 the axis 21 of each shaft 17 is positioned, in the said initial position, downstream of the associated cradle 7 in the direction of rotation of the drum 10 indicated by the arrow 12, whilst in the variant of FIG. 2 the axis 21 of each shaft 17 is positioned upstream of the associated cradle 7 with reference to the direction of rotation of the drum 10.

Each device 18 is operable to impart to the associated shaft 17 a reciprocating rotation about its axis over an arc of substantially 180° and includes a flat plate defining a bell crank 26 positioned within the drum 10 and provided with two arms 27 and 28. The arm 27 has at its free end a toothed sector 29 which meshes with a cylindrical pinion 30 keyed to the associated shaft 17, and is provided at the other end with a through hole engaged by a cylindrical pin 31. This latter extends towards the drum 10 parallel to the axis 21 and engages rotatably in a respective hole 32 formed through the drum 10 parallel to the axis 21 and engages rotatably in a respective hole 32 formed through the drum 10 to constitute a fulcrum for the rotation of the bell crank 26. The arm 28 of this latter has at its free end a through hole engaged by a pin 33 parallel to the pin 31 and projecting in the opposite direction to this latter from the bell crank 26. Onto the free end of the pin 33 there is keyed the inner ring of a bearing 34 the outer ring of which is able to roll in contact with the opposite lateral surfaces of an annular groove 35. This latter is formed on the outer lateral surface of a cylindrical drum 36 positioned within the drum 10 in a position coaxial therewith and defining, together with the groove 35, a fixed drum cam 37.

Each device 19 is operable to impart to the associated shaft 17 a reciprocating axial displacement towards and away from the outer surface of the drum 10, and includes a pin 38 the axis of which is parallel to the axis 11 and which is rotatably mounted through an associated hole 39 formed in a circumferential inner rib 40 of the drum 10. To the opposite ends of the pin 38 there are connected two cranks 41 and 42 rotatably supporting, at their free ends, respective radial bearings 43 and 44 the axes of which are parallel to the axis 11. The outer ring of the bearing 43 can roll within an annular groove 45 formed on the associated shaft 17 between the outer end of the pinion 30 and a collar 46. This latter is positioned on the associated shaft 17 within the drum 10 and at a distance from the associated plate 25 greater than the stroke imparted to the shaft 17 by the device 19 and less than the length of the pinion 30. The outer ring of the bearing 44 can roll within an annular groove 47 formed on the end surface of a disc 48 positioned facing an axial end of the drum 10 and defining, with the groove 47, a disc cam 49 coaxial with the drum 37 and fixed to it. In the variant illustrated in FIG. 2 the groove 35 of the cam 37 is formed in such a way as to impart to the cradles 7, starting from the said initial position, a rotation (indicated by an arrow 50) contrary to that imparted to the cradle 7 in the embodiment illustrated in FIG. 1. In particular, in the variant illustrated in FIG. 2, the cigarettes 3 are made to turn, starting from the initial position, in a sense opposite the direction of advance indicated by the arrow 12, and not in a corresponding sense as takes place in the device of FIG 1.

With reference to FIG. 1, the device 1 operates in the following way:

Initially, the cigarettes 2 and 3 leaving a cigarette making machine (not illustrated) are fed over the cradles 6 and 7 with their filters 8 and 9 facing one another in juxtaposed positions in such a way as to form the two rows 4 and 5 around the outer periphery of the drum 10.

During a first arc of rotation of the drum 10, starting from a position where the cigarettes 2 and 3 are loaded, the bearings 74 and 44 carried by the drum 10 follow arcs of the associated grooves 35 and 47 the curvature of which is constant and coaxial with the respective cams 37 and 49. Consequently, during movement along the said first arc, each cigarette 3 remains perfectly aligned with the corresponding cigaretted 2 and in substantial axial contact therewith. During a later, second arc of rotation of the drum 10, the groove 47 followed by the bearing 44 has a diminishing curvature in such a way as to cause a progressive separation of the bearings 44 and 43 from the axis 11 and a consequent raising of the associated cigarette 3 with respect to the corresponding cigarette 2. Simultaneously, the shape of the groove 35 causes a rotation of the sectors 29 and therefore of the shaft 17 in such a way that, at the end of the said second arc, each cigarette 3 has been raised above the corresponding cigarette 2 and rotated with respect to this latter by about 90°.

During the next, third, arc of rotation, the curvature of the groove 47 is such as to cause the lowering of the cigarette 3 until it is brought back to the level of the corresponding cigarette 2, whilst the rotation caused by the groove 35 continues until a complete rotation of 180° has been imparted to the cigarette 3.

Following the 180° rotation imparted to the cigarettes 3 by the associated devices 18, and the transverse translation imparted thereto by the associated devices 19, the cigarettes 3 reach a final position in which each is disposed parallel to and alongside the corresponding cigarette 2 downstream from this latter and with its filter 9 disposed on the same side as the filter 8 of the said corresponding cigarette 2. In conclusion, then, at the end of the said two displacements, the row 5 is completely superimposed over the row 4 in such a way as to form with this latter a single row of cigarettes having all their filters on the same side. Along this single row thus obtained the spacing of the cigarettes is constant and the separation or pitch of the cigarettes is equal to one-half of the spacing or pitch P. This is due to the fact that, as previously mentioned, the axis of each cigarette 3 is displaced with respect to the axis 21 of the associated shaft 17 by the distance d equal to one quarter of the pitch P.

Regarding the amount of elevation imparted to the cigarettes 3 to straddle the ends of the corresponding cigarettes 2, it is suitable to observe that, for a given pitch P or spacing between the cigarettes, it is smaller the greater the angle a, and is a maximum in the case of the angle a being equal to zero.

Figure 2:
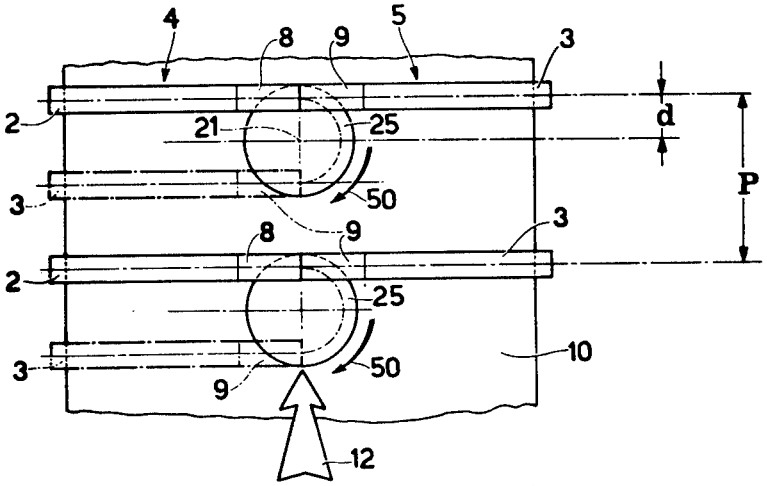
FIG. 2 schematically illustrates in plan a portion of a variant of the turnaround device of FIG. 1.

Finally, regarding the direction of rotation of the cigarettes 3 during their movement over the ends of the corresponding cigarettes 2, it is suitable to note that the direction of rotation indicated by the arrow 50 in FIG. 2 is more convenient than that illustrated in FIG. 1. In fact, in this latter case, the free ends of the cigarettes 3 are displaced, at the commencement of the rotation, in a direction corresponding to the direction of rotation of the drum 10, thereby generating a force which tends to separate the cigarettes 3 from the respective cradles 7. On the other hand, when the cigarettes 3 rotate in the sense indicated by the arrow 50 of FIG. 2, that is in a sense opposite the direction of rotation of the drum 10, there is exerted on these a reverse effect which tends to maintain them in contact with the associated cradles 7 thereby in this way eliminating the risk of accidental separation.

Obviously, as far as the device of FIG. 2 is concerned, in the event of an angle a between each axis 21 and a radius of the drum 10 passing through the associated hole 20 being provided, this angle a (not illustrated) will have an opposite orientation from that of the corresponding angle a of FIG. 1. In other words, whilst in FIG. 1 each axis 21 extends out from the drum 10 upstream of the corresponding radius 23 with respect to the sense of rotation indicated by the arrow 12, in FIG. 2, in the case (not illustrated) of an angle a different from zero, each axis 21 would extend out from the drum 10 downstream of the corresponding radius 23 with respect to the direction of rotation of the drum.

I claim:

1. A turnaround device for rod-like articles, in particular cigarettes, comprising a conveyor device (10) operable to advance the said articles in a direction transverse their axes, and a plurality of supports (6, 7) connected to the conveyor device (10) and aligned along first and second rows (4, 5) which are parallel to one another, the supports (6, 7) being spaced with a constant and equal pitch along both said rows (4, 5) and each support (6, 7) being able to house a respective rod-like article (2, 3), characterised by the fact that each support (6) of the first row (4) is fixed with respect to the conveyor device (10), whilst each support (7) of the second row (5) is connected to the conveyor device (10) by means of an associated turnaround unit (16); each turnaround unit (16) comprising first actuator means (19) operable to impart to the associated support (7) a reciprocating translational movement in a direction of translation substantially transverse to both a longitudinal axis of the support itself and to the direction of advance, and second actuator means (18) operable to impart to the associated support (7) a rotation through 180° starting from an initial position of juxtaposition with a corresponding support (6) of the first row (4) and about an axis of rotation (21) substantially parallel to the direction of the said translation, located at the end of the associated article (3) facing the support (6) of the first row (4) in the initial position, and displaced with respect to the longitudinal axis of the associated support (7) by a distance equal to one quarter of the pitch or spacing of the supports (6, 7).

2. A device according to claim 1 in which each turnaround unit (16) further includes a shaft (17) coaxial to the axis of rotation (21) and coupled in a rotatable and axially slidable manner to the conveyor device (10); each shaft being further coupled to the associated first and second actuator means (19, 18) and carrying, connected to one end, a respective support (7) of the second row (5).

3. A device according to claim 2 in which the first actuator means (19) of each turnaround unit (16) includes a pin (38) rotatably mounted on the conveyor device (10) in a position substantially parallel to the articles (2, 3) and a disc cam (49) the axis of which is parallel to that of the pin (38), the opposite ends of the pin (38) being rigidly connected to respective cranks (41, 42) one of which is coupled to the disc cam (49) and the other of which is coupled to the associated shaft (17).

4. A device according to claim 2 in which the second actuator means (18) of each turnaround unit (16) includes a toothed sector (29), a toothed sprocket (30) carried by the associated shaft (17) and a drum cam (37) the axis of which is substantially perpendicular to the axis of rotation (21), the toothed sector (29) being formed on a first arm of a bell crank (26) supported by the conveyor device (10) to rotate with respect to this latter about an axis parallel to the axis of rotation (21), and a second arm of the bell crank (26) being coupled to the said drum cam (37).

5. A turnaround device for rod-like articles, in particular cigarettes, comprising a conveyor device (10) operable to advance the said articles in a direction transverse their axes, and a plurality of supports (6, 7) connected to the conveyor device (10) and aligned along first and second rows (4, 5) which are parallel to one another, the supports (6, 7) being spaced with a constant and equal pitch along both said rows (4, 5) and each support (6, 7) being able to house a respective rod-like article (2, 3), each support (6) of the first row (4) being fixed with respect to the conveyor device (10), whilst each support (7) of the second row (5) is connected to the conveyor device (10) by means of an associated turnaround unit (16);

each turnaround unit (16) comprising first actuator means (19) operable to impart to the associated support (7) a reciprocating translational movement in a direction of translation substantially transverse to both a longitudinal axis of the support itself and to the direction of advance, and second actuator means (18) operable to impart to the associated support (7) a rotation through 180° starting from an initial position of juxtaposition with a corresponding support (6) of the first row (4) and about an axis of rotation (21) substantially parallel to the direction of the said translation, located at the end of the associated arricle (3) facing the support (6) of the first row (4) in the initial position, and displaced with respect to the longitudinal axis of the associated support (7) by a distance equal to one quarter of the pitch or spacing of the supports (6, 7); and the second actuator means (18) imparting to the associated support (7) a rotation in a direction such that during a first part of the 180° rotation starting from the initial position the velocity of the support (7) is added to the velocity of the advancement due to the conveyor device (10).

6. A turnaround device for rod-like articles, in particular cigarettes, comprising a conveyor device (10) operable to advance the said articles in a direction transverse their axes, and a plurality of supports (6, 7) connected to the conveyor device (10) and aligned along first and second rows (4, 5) which are parallel to one another, the supports (6, 7) being spaced with a constant and equal pitch along pitch along both said rows (4, 5) and each support (6, 7) being able to house a respective rod-like article (2, 3), characterised by the fact that each support (6) of the first row (4) is fixed with respect to the conveyor device (10), whilst each support (7) of the second row (5) is connected to the conveyor device (10) by means of an associated turnaround unit (16);

each turnaround unit (16) comprising first actuator means (19) operable to impart to the associated support (7) a reciprocating translational movement in a direction of translation substantially transverse to both a longitudinal axis of the support itself and to the direction of advance, and second actuator means (18) operable to impart to the associated support (7) a rotation through 180° starting from an initial position of juxtaposition with a corresponding support (6) of the first row (4) and about an axis of rotation (21) substantially parallel to the direction of the said translation, located at the end of the associated article (3) facing the support (6) of the first row (4) in the initial position, and displaced with respect to the longitudinal axis of the associated support (7) by a distance equal to one another of the pitch or spacing of the supports (6, 7); and the actuator means (18) imparting to the associated support (7) a rotation in a direction such that during a first part of the 180° rotation starting from the initial position the velocity of the support (7) is subtracted from the velocity of advance due to the conveyor device (10).

* * * * *